United States Patent [19]

Hendricks

[11] 4,030,194

[45] June 21, 1977

[54] NESTED HUNTING KNIFE

[76] Inventor: Lorenzo R. Hendricks, 9919 E. Apache Trail, Mesa, Ariz. 85207

[22] Filed: Sept. 9, 1976

[21] Appl. No.: 721,666

[52] U.S. Cl. ..... 30/143; 30/162
[51] Int. Cl.[2] ..... B26B 1/08
[58] Field of Search ..... 30/125, 143, 151, 152, 30/162; 7/1 B

[56] References Cited

UNITED STATES PATENTS

| | | | |
|---|---|---|---|
| 2,105,239 | 1/1938 | Bachtold | 30/151 |
| 2,545,121 | 3/1951 | Szopa | 30/152 X |
| 3,252,489 | 5/1966 | Huston | 30/151 X |

FOREIGN PATENTS OR APPLICATIONS

| | | | |
|---|---|---|---|
| 1,057,029 | 3/1959 | Germany | 30/125 |

*Primary Examiner*—James L. Jones, Jr.
*Assistant Examiner*—J. C. Peters
*Attorney, Agent, or Firm*—James W. McFarland

[57] ABSTRACT

A combination hunting knife includes a larger, integrally formed knife having a handle portion comprised of a pair of parallel tangs defining an elongated open space therebetween which snugly receives a smaller knife for storage. An integral, resilient cantilever acts as a detent for releasably retaining the smaller knife within the larger knife, while the relative configurations of the two knives are such that the honed knife edge of the smaller knife does not contact and is protected from engagement with the larger knife.

13 Claims, 8 Drawing Figures

NESTED HUNTING KNIFE

BACKGROUND OF THE INVENTION

This invention relates to hunting knives, and relates more particularly to a combination of larger and smaller hunting knives compactly arranged as a unitary article, yet which knives are useful independent from one another.

For hunting, field dressing and other similar purposes, distinctly different types of knives are required to accomplish different purposes. For field dressing or taxidermy operations, for instance, a large, relatively broad bladed, strong knife is necessary for large cutting, skinning, etc. A smaller, scalpel-type knife is required to accomplish the more delicate tasks relating to preparation of a game animal head, particularly in areas of the eyes, ears, nose,mouth, etc. Compactness, ease and efficiency of operation, as well as safe and secure portability are highly advantageous features for such types of knives.

Exemplarly of prior arrangements for combining different utility tools may be found in the following U.S. Pat. Nos: 2,105,239 of Bachtold; 2,397,875 of Marshaus; 2,545,121 of Szopa; 3,252,489 of Huston et al; and 3,613,289 of Mozey, Jr. None of the above references disclose arrangements with the structural features and attendant advantages associated with the present invention.

SUMMARY OF THE INVENTION

It is a primary object of the present invention to provide an improved combination hunting knife apparatus which comprises a pair of nested, smaller and larger knives wherein the smaller knife is completely contained and carried within the handle of the larger knife, yet which handle of the larger knife is so relatively configured to facilitate simple and easy removal and insertion of the smaller knife such that the larger knife may be used completely independently of the smaller knife and regardless of whether or not the smaller knife is being carried therewithin.

More particularly, an important object of the present invention is to provide a nested hunting knife apparatus as set forth in the preceding paragraph, wherein the larger knife handle comprises a pair of spaced, elongated tangs defining an elongated, open sided groove therebetween into which the smaller knife snugly fits, the open sides of the groove facilitating easy and convenient insertion and removal of the smaller knife.

Another important object of the present invention is to provide a pair of hunting knives, the smaller one of which is storable within the handle of the large knife, wherein is provided an improved, integrally formed detent mechanism of vastly simpler and more economical structure which does not detract from the aesthetic features of the overall knife.

Another important object is to provide nested hunting knife arrangement as set forth in the preceding paragraphs wherein the two knives are relatively configured and arranged to provide substantially complete protection for the honed edge of the blade of the smaller knife.

These and other more particular objects and advantages of the present invention are specifically set forth in or will become apparent from the following detailed description of a preferred embodiment of the invention when read in conjunction with the accompanying drawing.

DETAILED DESCRIPTION OF THE PREFERRED EMBODIMENT

Figure 1:
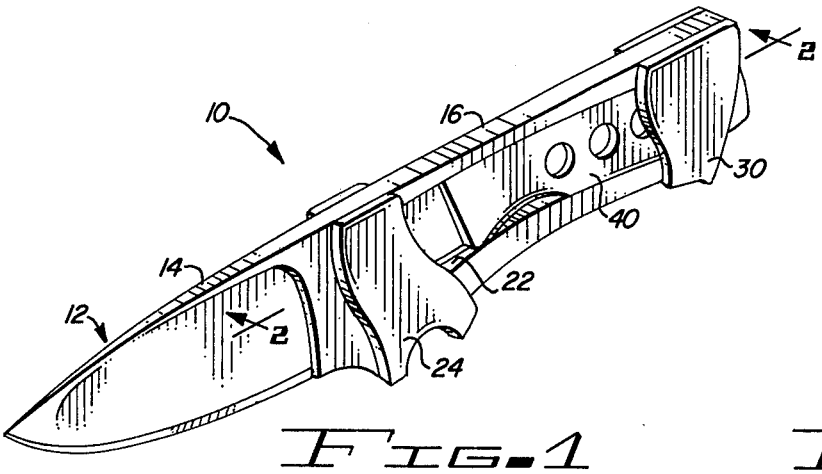
FIG. 1 is a perspective view of nested hunting knife apparatus as contemplated by the present invention.

Referring now more particularly to the drawing, there is illustrated a combination hunting knife apparatus generally denoted by the numeral 10 which includes a larger hunting knife 12 of generally thin, elongated, slightly curved structure having a blade portion 14 at one end and a handle portion 16 at the other end. Handle portion 16 includes a pair of laterally spaced, complementally curved, parallel, upper and lower tangs 18 and 20 defining an elongated, longitudinally extending, open space or groove 22 therebetween. Preferably, the blade and handle portions 14 and 16 are integrally formed from a single piece of steel. The handle portion 16 further includes guide means or side support elements including a pair of guard bolsters 24 secured, such as by a plurality of rivets 26, to opposite transverse sides of the larger knife in the area of the handle portion adjacent the blade portion 14. By appropriaate plating or other finishing technique to the outer surface of bolsters 26, the rivets are covered and hidden to enhance the eye-pleasing appearance of the apparatus as shown in FIG. 1. Guard bolsters 24 enclose the sides of and define a first section 28 of groove 22 at the end thereof proximate the blade portion 14. The handle portion 16 further includes a second guard means or side support elements in the form of a pair of rearwardly located pommell bolsters 30 secured by rivets to both upper and lower tangs 18 and 20 at the remote end of the hand portion. Similar to the guard bolsters, the pommell bolsters 30 enclose the open sides of and define a second section 32 of groove 22. It will be noted that the end of groove 20 at section 32 is open.

At the remote end of handle portion 16, the upper tang 18 has a relatively deep, longitudinal slit 34 to define detent means in the form of an elongated, thin, resilient cantilever 36 whose inner end is integrally formed with and permanently secured to upper tang 18. Cantilever 36 is hardened and tempered to present a leaf spring. The outer end of cantilever 36 is thus resiliently shiftable in a lateral direction toward and away from tang 20 and includes a detent in the form of a locking projection 38 firmly affixed to cantilever 36.

It is important to note that the above described configuration of handle portion 16 of the larger hunting knife provides a groove 22 which has side support elements at opposite ends thereof but which, between the side support elements 24 and 30, has completely open sides.

Figure 3:
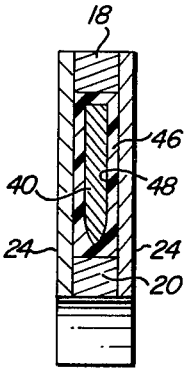
FIG. 3 is a cross sectional elevational view taken along lines 3—3 of FIG. 2.
Figure 2:
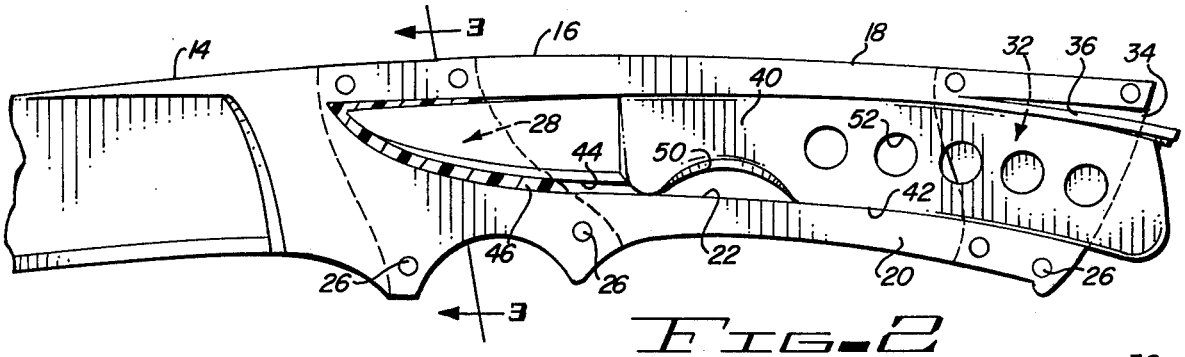
FIG. 2 is a partial, enlarged side view taken along lines 2—2 of FIG. 1 with portions broken away to reveal internal details of construction.
Figure 6:
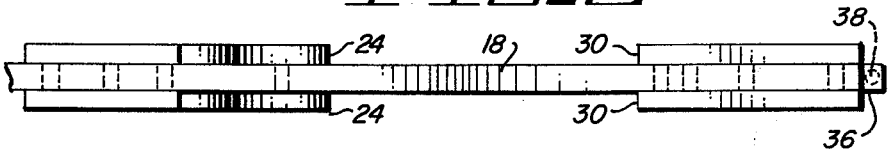
FIG. 6 is a partial, top plan view of the hunting knife apparatus.
Figure 4:
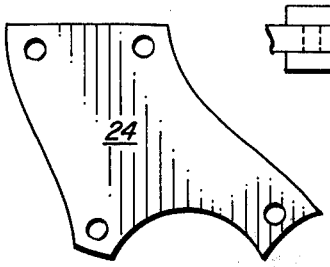
FIG. 4 is a side view of the front guard bolster.
Figure 7:
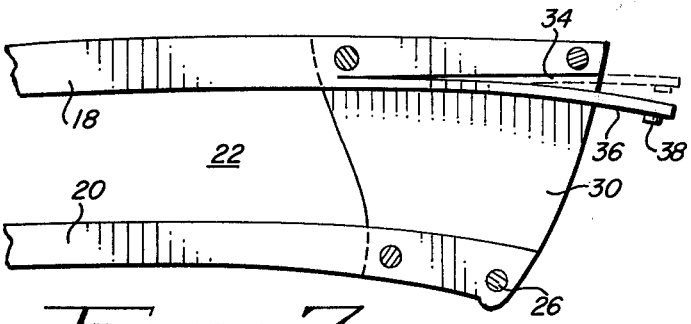
FIG. 7 is a partial, enlarged side view of the remote end of the larger knife handle with portions broken away to reveal details of construction.
Figure 5:
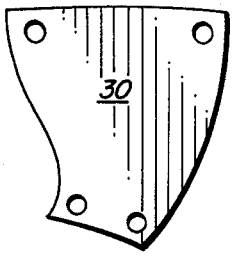
FIG. 5 is a side view of the rear pommell bolster.
Figure 8:
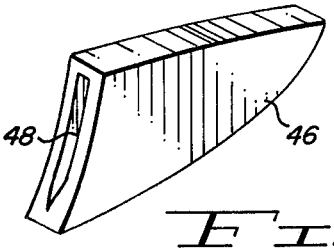
FIG. 8 is a perspective view of the blade protecting material insert.

Apparatus 10 further includes a second, smaller scalpel knife 40 preferably made as a unitary article with integral blade and handle portions. Knife 40 is completely separate from larger knife 12. Thus, each knife 12 and 40 has its own blade and handle portions to allow use independently of the other. Smaller knife 40 is configured and arranged relative to the larger knife so as to be snugly received within groove 22 in its stored disposition as illustrated in FIGS. 1 and 3. The handle portion of scalpel knife 40 is curved complementally to the upper and lower tangs 18 and 20 to be snugly received within groove 22. Preferably, the blade portion of scalpel 40 is of slightly less lateral width than its handle portion so that the lower surface 42 of the handle portion of the smaller knife rides upon the lower tang 20 to place the honed knife edge 44 of the smaller knife in spaced disposition from the handle portion 16 of the larger knife. In this manner it may be assured that the honed knife edge is protected from contact with the metal surface and the larger blade while therewithin or during insertion and removal of the smaller knife. For further protection of the blade portion of scalpel knife 40, an insert 46 of rigid, blade protecting material such as fiberglass, polytetrafluoroethylene or other equivalent material is firmly secured to handle portion 16 to substantially fill the first section 28 of groove 22. Insert 46 is provided with an elongated aperture 48 which snugly receives the tip end of the blade portion of the smaller scalpel knife in surrounding, protective relationship upon placing the smaller knife in its stored position. Similar to the larger knife, the smaller knife 40 may preferably be configured with a finger receiving depression 50 as well as a plurality of transverse holes 52 which function for aesthetic purposes as well as to reduce and/or control the weight and balance of the smaller knife while permitting it to be formed as an integral, unitary body.

In use, smaller knife 40 may be easily and smoothly inserted into the larger knife to its stored disposition by passage through the remote, open end of groove 22, through section 32 of groove 22, and to the stored position substantially completely contained within the handle portion 16 of the larger knife. The tip end of the blade of the smaller knife is snugly carried within aperture 48 of insert 46. Upon complete insertion of the smaller knife, the resilient cantilever 36 shifts laterally downwardly such that projection 38 snaps over and engages the outer end of the smaller knife to retain or substantially lock the smaller knife in its stored disposition. The detent means securely retains the smaller knife within the larger knife not only to permit easy and safe portability of the unit, but also with sufficient securement to permit normal usage of the larger hunting knife while the smaller knife is stored therewithin.

The smaller knife is simply, quickly and easily completely withdrawn from the larger knife by shifting the cantilever 36 slightly upwardly to clear the smaller knife. Bolsters 24 and 30 smoothly guide knife 40 longitudinally along groove 22. Through the relatively expansive open sides of groove 22 between the guard and pommell bolsters, the smaller knife can be readily and easily grasped to facilitate simple removal of the smaller knife from the larger knife. Upon such removal, the larger and smaller knives 12 and 40 may be used independently of one another.

From the foregoing it will be apparent that the present invention provides an improved combination hunting knife apparatus which includes a pair of completely independent, separately useful knives, one of which can be substantially completely carried inside the handle of the other, yet which provides a simple, easy, and effective method of inserting and removing the smaller knife from the larger knife. At the same time the apparatus provides such advantages without incorporation of other retaining elements which must be removed from either the knives, which elements would thus subject to loss and/or damage that would render the unit completely inoperative. At the same time, however, the present invention provides such appartus with aesthetically pleasing and highly utilitarian design characterized by clean, unencumbered lines.

Various modifications and alterations to the specific arrangement illustrated will be apparent to those skilled in the art. Accordingly, the foregoing detailed description of a preferred embodiment of the invention should be considered exemplary in nature and not as limited to the scope and spirit of the invention as set forth in the appended claims.

I claim:

1. Hunting knife apparatus, comprising:

a larger knife having blade and handle portions, said handle portion having a groove extending longitudinally therealong open at the end of said handle portion remote from said blade portion;

a smaller knife having blade and handle portions separate from those of said larger knife, said smaller knife configured and arranged relative to said handle portion of the larger knife to be inserted into said groove through said remote end of said handle portion of the larger knife and to be substantially completely received within said groove;

guide means on said handle portion of the larger knife configured and arranged to guide said smaller knife longitudinally along said groove; and detent means carried by one of said larger and smaller knives and engageable with the other of said larger and smaller knives to retain said smaller knife within said groove, said detent means being disengageable to allow complete withdrawal of said smaller knife from said groove, said groove being open along a sufficient length of said handle portion of the larger knife to allow easy grasping of said smaller knife while within said groove to facilitate insertion and removal of the smaller knife.

2. Apparatus as set forth in claim 1, wherein said handle portion of the larger knife comprises a pair of laterally spaced tangs extending rearwardly from said blade portion of the larger blade and defining said groove between said tangs.

3. Apparatus as set forth in claim 2, wherein said pair of tangs are substantially parallel arranged and complementally curved along the lengths thereof.

4. Apparatus as set forth in claim 2, wherein said guide means include at least one side support element on each side of said tangs, each of said elements intersecured to and laterally traversing said pair of tangs.

5. Apparatus as set forth in claim 1, wherein said guide means comprise a pair of pommell bolsters secured to opposite sides of said handle portion of the larger knife adjacent said remote end thereof and laterally traversing said groove.

6. Apparatus as set forth in claim 5, wherein said guide means further comprise a pair of guard bolsters secured to opposite sides of said handle portion of the larger knife adjacent said blade portion of the larger knife, said guard bolsters laterally traversing said groove.

7. Apparatus as set forth in claim 6, further including an insert of rigid, blade protecting material in said groove and secured to said guard bolsters, said insert having an aperture therein for snugly receiving the tip of said blade portion of the smaller knife in surrounding, protective arrangement.

8. Apparatus as set forth in claim 1, further including an insert of rigid, blade protecting material disposed in said groove adjacent said blade portion of the larger knife, said insert having an aperture therein for snugly receiving the tip of said blade portion of the smaller knife in surrounding, protective arrangement.

9. Apparatus as set forth in claim 1, wherein said detent means is carried on said larger knife.

10. Apparatus as set forth in claim 9, wherein said detent means comprises a resilient cantilever having one end permanently secured to said handle portion of the larger knife, the other end of said cantilever releasably engageable with said handle portion of the smaller knife.

11. Apparatus as set forth in claim 1, wherein said blade portion of the smaller knife includes a honed knife edge, said smaller knife configured whereby said knife edge thereof does not contact said larger knife when placed in said groove.

12. Apparatus as set forth in claim 11, wherein said blade portion of the smaller knife is of less lateral width than said handle portion of the smaller knife to prevent contact of said knife edge with said handle portion of the larger knife while said smaller knife is in said groove.

13. A combination hunting knife, comprising:

a larger hunting knife having integral blade and handle portions, said handle portion including a pair of laterally spaced substantially parallel, curved upper and lower tangs extending longitudinally rearwardly from said handle portion, said tangs defining a longitudinal, elongated groove therebetween;

a pair of side guard bolsters affixed to said larger knife adjacent the end of said tangs proximate said blade portion and enclosing a first section of said groove; a pair of side pommell bolsters affixed to said tangs at the end thereof remote from said blade portion and enclosing a second section of said groove;

a smaller scalpel knife having integrally formed blade and handle portions separate from those of said larger knife, said scalpel knife sized and configured to be substantially completely inserted through said second section of the groove to a stored position snugly fitting in said groove with the tip of said blade portion of the scalpel knife fitting within said first section of the groove;

an insert of rigid, blade protective material secured to said pair of guard bolsters and located within said first section of the groove, said insert having an aperture therein configured and arranged to snugly receive said tip of the scalpel knife in surrounding, protective arrangement;

said upper tang having a longitudinally extending slit at said remote end to define a thin cantilever having one end integral with said upper tang, said cantilever laterally shiftable toward and away from said lower tang;

a defent affixed to the other end of said cantilever, said detent operable upon inserting said scalpel knife into said groove to said stored position to snap over and engage the end of said handle portion of the scalpel knife to lock the latter in said stored position to permit use of said larger knife with said scalpel knife stored therein, said cantilever being shiftable to disengage said detent from said scalpel knife to allow complete withdrawal of said scalpel knife from said larger knife and thereupon allow independent use of said scalpel knife and larger knife; and said groove being open between said pairs of guard and pommell bolsters to allow easy grasping of the sides of said scalpel knife while in its stored position to facilitate removal of the scalpel knife from said groove.

* * * * *